US010480081B2

(12) United States Patent
Shigeru

(10) Patent No.: US 10,480,081 B2
(45) Date of Patent: Nov. 19, 2019

(54) METHOD OF MANUFACTURING DISHWASHER

(71) Applicant: SUMITOMO OSAKA CEMENT CO., LTD., Tokyo (JP)

(72) Inventor: Keijiro Shigeru, Tokyo (JP)

(73) Assignee: SUMITOMO OSAKA CEMENT CO., LTD., Tokyo (JP)

( * ) Notice: Subject to any disclaimer, the term of this patent is extended or adjusted under 35 U.S.C. 154(b) by 0 days.

(21) Appl. No.: 15/762,394

(22) PCT Filed: Sep. 2, 2016

(86) PCT No.: PCT/JP2016/075780
§ 371 (c)(1),
(2) Date: Mar. 22, 2018

(87) PCT Pub. No.: WO2017/056845
PCT Pub. Date: Apr. 6, 2017

(65) Prior Publication Data

US 2018/0282876 A1 Oct. 4, 2018

(30) Foreign Application Priority Data

Sep. 28, 2015 (JP) ..... 2015-189189

(51) Int. Cl.
*C23C 26/00* (2006.01)
*A47L 15/42* (2006.01)
*C23C 18/12* (2006.01)

(52) U.S. Cl.
CPC ..... *C23C 26/00* (2013.01); *A47L 15/42* (2013.01); *A47L 15/4246* (2013.01); *C23C 18/1216* (2013.01); *C23C 18/1225* (2013.01); *C23C 18/1254* (2013.01); *C23C 18/1241* (2013.01)

(58) Field of Classification Search
CPC ..... C23C 26/00
See application file for complete search history.

(56) References Cited

U.S. PATENT DOCUMENTS 5,399,363 A * 3/1995 Liversidge ..... A61K 9/145 424/490
2006/0118141 A1* 6/2006 Andriola ..... C11D 3/0052 134/42

FOREIGN PATENT DOCUMENTS

JP 2003-299606 A 10/2003
JP 2007046097 A * 2/2007
JP 2010106308 A * 5/2010

OTHER PUBLICATIONS

International Search Report for PCT/JP2016/075780 (dated Nov. 22, 2016).

* cited by examiner

*Primary Examiner* — Tabatha L Penny
(74) *Attorney, Agent, or Firm* — Merchant & Gould P.C.

(57) ABSTRACT

Disclosed is a method of manufacturing a dishwasher including: forming a first layer containing zirconium oxide and silicon oxide on a surface of the inner wall at a heat treatment of 200° C. or higher; forming a second layer containing an oxoacid on a surface of the first layer at a heat treatment temperature lower than the heat treatment temperature of the first layer; and obtaining a thin-film layer containing zirconium oxide and silicon oxide on the surface of the inner wall and having a contact angle of water of 20° or less on the surface, after removing the second layer by using a washing method, in which the first layer contains the zirconium oxide in an amount of 80 mass % or more in terms of oxide and the silicon oxide in an amount of 1-20 mass % in terms of oxide.

7 Claims, No Drawings

METHOD OF MANUFACTURING DISHWASHER

TECHNICAL FIELD

The present invention relates to a method of manufacturing a dishwasher.

This application is a National Stage Application under 35 U.S.C. § 371 of International Application No. PCT/JP2016/075780 filed Sep. 2, 2016, which claims the benefit of priority to Japanese Patent Application No. 2015-189189, filed on Sep. 28, 2015, the disclosures of which are incorporated herein by reference in their entireties. The International Application was published in Japanese on Apr. 6, 2017 as WO 2017/056845.

BACKGROUND

As a method of easily removing oil stains adhered onto a hydrophilic coating, a method using water washing is widely known. The reason why oil stains can be easily removed by water washing as described above is because water easily infiltrates into the interface between the oil stains and the hydrophilic coating.

A method in which a hydrophilic coating is formed on the surface of a stainless steel plate forming the inner wall of a dishwasher such that adhesion of stains to the surface of the inner wall is prevented, and thus a drying time of dishes can be shortened is known (for example, refer to Patent Literature No. 1).

However, this method has a problem that the durability of the film of the stainless steel plate is insufficient in a case where the film is exposed to an alkaline detergent at a high temperature for a long period of time. The problem of insufficient alkali resistance is attributable to a large amount of a silicic acid component contained in the hydrophilic coating. Since the silicic acid component dissolves in an alkaline detergent solution at a high temperature, the hydrophilic coating cannot withstand long-term use.

As a composition of an alkali-resistant hydrophilic coating, for example, a composition containing zirconium oxide having excellent alkali resistance and a phosphoric acid component having excellent hydrophilicity is considered instead of the silicic acid component. However, even in a case where the durability (alkali resistance) of the hydrophilic coating in a high-temperature alkaline environment in a dishwasher is improved, a problem of impairment of acid resistance is incurred.

Calcium contained in tap water adheres to the inner wall of a dishwasher in a large amount. The calcium is not removed by an alkaline detergent, and thus needs to be dissolved by an acidic detergent and removed. Since calcium is an inorganic substance, even when calcium adheres to the hydrophilic coating, it is difficult to remove the calcium along with oil components, and it is necessary to periodically remove the calcium using an acidic detergent. As described above, there is a problem that calcium adhered to the hydrophilic coating cannot be sufficiently removed.

CITATION LIST

Patent Literature

[Patent Literature No. 1] Japanese Laid-open Patent Publication No. 2003-299606

SUMMARY OF INVENTION

Technical Problem

The present invention has been made taking the foregoing circumstances into consideration, and an object thereof is to provide a method of manufacturing a dishwasher provided with an inner wall made of a stainless steel plate having a hydrophilic coating with durability against an alkaline detergent and sufficient durability against an acidic detergent on the surface.

Solution to Problem

The inventors intensively studied to solve the problems. As a result, it was found that in a method of manufacturing a dishwasher having an inner wall made of a stainless steel plate, forming a first layer containing zirconium oxide and silicon oxide on the surface of the inner wall at a heat treatment temperature of 200° C. or higher, forming a second layer containing an oxoacid on the surface of the first layer at a heat treatment temperature lower than the heat treatment temperature of the first layer, obtaining a thin-film layer containing zirconium oxide and silicon oxide on the surface of the inner wall and having a contact angle of water of 20 degrees or less on the surface after removing the second layer by using a washing method, and causing the first layer to contain the zirconium oxide in an amount of 80 mass % or more in terms of oxide and the silicon oxide in an amount of 1 mass % to 20 mass % in terms of oxide, exhibited hydrophilicity by the effect of the second layer, and further exhibited excellent durability against an alkaline detergent for dishwashing and an acidic detergent for calcium removal. Accordingly, the present invention was completed.

The present invention provides a method of manufacturing a dishwasher having an inner wall made of a stainless steel plate, including steps of: forming a first layer containing zirconium oxide and silicon oxide on a surface of the inner wall at a heat treatment temperature of 200° C. or higher; forming a second layer containing an oxoacid on a surface of the first layer at a heat treatment temperature lower than the heat treatment temperature of the first layer; and obtaining a thin-film layer containing zirconium oxide and silicon oxide on the surface of the inner wall and having a contact angle of water of 20 degrees or less on the surface, after removing the second layer by using a washing method, in which the first layer contains the zirconium oxide in an amount of 80 mass % or more in terms of oxide and the silicon oxide in an amount of 1 mass % to 20 mass % in terms of oxide.

The step of forming the first layer may include steps of: forming a first coating film by applying a first coating liquid containing a precursor of the zirconium oxide and a precursor of the silicon oxide to the surface of the inner wall; and forming the first layer on the surface of the inner wall by subjecting the first coating film to a heat treatment at 200° C. or higher.

The step of forming the second layer may include steps of: forming a second coating film by applying a second coating liquid containing the oxoacid to the surface of the first layer; and forming the second layer on the surface of the first layer by subjecting the second coating film to a heat treatment at a temperature lower than the heat treatment temperature of the first layer.

Furthermore, the present invention provides a dishwasher which is obtained by the method of manufacturing a dishwasher and has the inner wall made of the stainless steel plate including the thin-film layer having hydrophilicity.

Advantageous Effects of Invention

According to the method of manufacturing a dishwasher of the present invention, a dishwasher having a hydrophilic inner wall made of stainless steel is obtained. Not only are stains such as oil less likely to adhere to the inner wall of the dishwasher, but also water droplets do not form on the inner wall after dishwashing. Therefore, the dishwasher enables quick drying and has excellent energy saving effects. Furthermore, the dishwasher has excellent durability against an alkaline detergent and an acidic detergent.

DESCRIPTION OF EMBODIMENTS

An embodiment of a method of manufacturing a dishwasher of the present invention will be described.

The embodiment is described in detail for better understanding of the gist of the invention, and does not limit the present invention if not particularly specified.

[Method of Manufacturing Dishwasher]

A method of manufacturing a dishwasher of the embodiment is a method of manufacturing a dishwasher having an inner wall made of a stainless steel plate, including steps of: forming a first layer containing zirconium oxide and silicon oxide on the surface of the inner wall at a heat treatment temperature of 200° C. or higher; forming a second layer containing an oxoacid on the surface of the first layer at a heat treatment temperature lower than the heat treatment temperature of the first layer; and obtaining a thin-film layer containing zirconium oxide and silicon oxide on the surface of the inner wall and having a contact angle of water of 20 degrees or less on the surface, after removing the second layer by using a washing method, in which the first layer contains the zirconium oxide in an amount of 80 mass % or more in terms of oxide and the silicon oxide in an amount of 1 mass % to 20 mass % in terms of oxide.

In the step of forming the first layer (hereinafter, referred to as "first step"), specifically, a first coating liquid containing a zirconium compound is coated to the surface of the inner wall made of the stainless steel plate to form a first coating film made of the first coating liquid, and the first coating film is subjected to a heat treatment at 200° C. or higher, thereby forming the first layer containing the zirconium oxide and the silicon oxide on the surface of the inner wall made of the stainless steel plate.

The first coating liquid contains a precursor of the zirconium oxide, a precursor of the silicon oxide, and a solvent in which the precursor of the zirconium oxide and the precursor of the silicon oxide are dissolved.

As the precursor of the zirconium oxide, at least one selected from the group consisting of an alkoxide of zirconium, a hydrolysate of an alkoxide of zirconium, a chelated compound of an alkoxide of zirconium, various salts of zirconium, and zirconia colloid may be employed.

The alkoxide of zirconium is not particularly limited, and for example, n-butoxide and propoxide may be employed.

As the precursor of the silicon oxide, at least one selected from the group consisting of an alkoxide of silicon, a hydrolysate of an alkoxide of silicon, various salts of an oxyacid of silicon, and colloidal silica may be employed.

As a silicon oxide component, one or two or more components selected from the alkoxide of silicon as the precursor of the silicon oxide, a hydrolysate of the alkoxide, various salts of an oxyacid of silicon, and colloidal silica may be exemplified.

As the solvent, organic solvents such as alcohols, ethers, and ketones are used. Water can also be added to the first coating liquid in a range in which the precursor of the silicon oxide can be dissolved.

The first coating liquid may contain, in addition to the alkoxide, a sol dispersion of zirconium oxide and a water-soluble salt.

The content rate of the precursor of the zirconium oxide in the first coating liquid is preferably set to cause the content rate of the zirconium oxide in terms of oxide to be 80 mass % or more, and is more preferably set to cause the content rate of the zirconium oxide in terms of oxide to be 85 mass % or more.

When the content rate of the precursor of the zirconium oxide in the first coating liquid is set to cause the content rate of the zirconium oxide in terms of oxide to be less than 80 mass %, the thin-film layer that is finally obtained cannot achieve sufficient alkali resistance.

The content rate of the precursor of the silicon oxide in the first coating liquid is preferably set to cause the content rate of the silicon oxide in terms of oxide to be 20 mass % or less, more preferably set to cause the content rate of the silicon oxide in terms of oxide to be 15 mass % or less, and even more preferably set to cause the content rate of the silicon oxide in terms of oxide to be 5 mass % to 15 mass %.

When the content rate of the precursor of the silicon oxide in the first coating liquid is set to cause the content rate of the silicon oxide in terms of oxide to exceed 20 mass %, the thin-film layer that is finally obtained cannot achieve sufficient alkali resistance.

A method of applying the first coating liquid is not particularly limited, and for example, a spray method or a roll method is suitably used.

In the first step, the temperature at which the coating film made of the first coating liquid is subjected to the heat treatment, that is, the temperature at which the inner wall made of the stainless steel plate is heated is 200° C. or higher, preferably 250° C. or higher, and more preferably 250° C. to 300° C.

In the first step, when the temperature at which the inner wall made of the stainless steel plate is heated is set to 200° C. or higher, the solvent evaporates such that the obtained first layer firmly adheres to the surface of the inner wall made of the stainless steel plate.

In the first step, the thickness of the coating film made of the first coating liquid is preferably adjusted such that the thickness of the first layer formed after the heat treatment of the coating film made of the first coating liquid becomes 0.1 μm to 1 μm.

When the thickness of the first layer is 0.1 μm or more, the thin-film layer that is finally obtained has sufficient hydrophilicity. On the other hand, when the thickness of the first layer is 1 μm or less, the thin-film layer that is finally obtained does not whiten.

The first layer formed in the first step contains the zirconium oxide in an amount of 80 mass % or more in terms of oxide and the silicon oxide in an amount of 1 mass % to 20 mass % in terms of oxide, and preferably contains the zirconium oxide in an amount of 85 mass % to 95 mass % and the silicon oxide in an amount of 5 mass % to 15 mass %.

When the content rate of the zirconium oxide contained in the first layer in terms of oxide is less than 80 mass %, the thin-film layer that is finally obtained cannot achieve sufficient alkali resistance.

When the content rate of the silicon oxide contained in the first layer in terms of oxide is more than 20 mass %, the thin-film layer that is finally obtained cannot achieve sufficient alkali resistance. When the first layer contains no silicon oxide at all, the first layer may not adhere to the surface of the inner wall made of the stainless steel plate. Therefore, in the first layer, the content rate of the silicon oxide in terms of oxide is 1 mass % to 20 mass %.

It is preferable that the first layer does not contain other components that impair acid resistance and alkali resistance other than silicon oxide, such as alkali metals, alkaline earth metals, and organic substances.

In the step of forming the second layer (hereinafter, referred to as "second step"), specifically, a second coating liquid containing an oxoacid is coated to the surface of the first layer to form a coating film made of the second coating liquid, and the coating film is subjected to a heat treatment at a temperature lower than the heat treatment temperature of the first coating film, thereby forming the second layer containing the oxoacid on the surface of the first layer.

The purpose of forming the second layer is to increase the hydrophilicity of the first layer. The first layer does not exhibit sufficient hydrophilicity on its own. However, the first layer exhibits hydrophilicity by contact with the oxoacid of the second layer. This is presumably because the oxoacid chemically affects the zirconium oxide in the first layer.

Therefore, even after the second layer is removed by a water washing method, the hydrophilicity of the first layer (the thin-film layer) is retained.

The second coating liquid contains an oxoacid source and a solvent in which the oxoacid source is dissolved.

As the oxoacid source, at least one selected from the group consisting of an oxoacid of phosphorus, aluminum, sulfur, and boron, or a salt thereof is preferable.

Examples of the oxoacid of phosphorus include phosphoric acid, pyrophosphoric acid, polyphosphoric acid, and meta-phosphoric acid. Examples of the salt of the oxoacid of phosphorus include sodium pyrophosphate, sodium polyphosphate, and sodium meta-phosphate.

Examples of the oxoacid of aluminum include aluminum acid and meta-aluminum acid. Examples of the salt of the oxoacid of aluminum include sodium aluminate.

Examples of the oxoacid of sulfur include sulfuric acid, thiosulfuric acid, pyrosulfuric acid, and metasulfuric acid. Examples of the salt of the oxoacid of sulfur include sodium sulfate, sodium thiosulfate, and sodium sulfite.

Examples of the oxoacid of boron include boric acid, metaboric acid. Examples of the salt of the oxoacid of boron include sodium borate.

As the solvent, water, or organic solvents such as alcohols, ethers, and ketones are used. In a case where water is selected as the solvent of the second coating liquid, organic solvents such as alcohols, ethers, and ketones can be added in a range in which the oxoacid can be dissolved.

The content rate of the oxoacid source in the second coating liquid is preferably 0.5 mass % to 5 mass %, and more preferably 1 mass % to 3 mass %.

When the content rate of the oxoacid source in the second coating liquid is less than 0.5 mass %, the amount of reactions is insufficient, and thus the thin-film layer that is finally obtained cannot achieve sufficient hydrophilicity. On the other hand, when the content rate of the oxoacid source in the second coating liquid exceeds 5 mass %, the unreacted oxoacid becomes significantly excessive, which is not economically preferable.

A method of coating the second coating liquid is not particularly limited, and for example, a spray method or a roll method is suitably used.

In the second step, the temperature at which the coating film made of the second coating liquid is subjected to the heat treatment, that is, the temperature at which the inner wall made of the stainless steel plate is heated is set to be lower than the temperature at which the inner wall made of the stainless steel plate is heated in the first step. The temperature at which the coating film made of the second coating liquid is subjected to the heat treatment is set to be lower than the temperature at which the coating film made of the first coating liquid is subjected to the heat treatment preferably by 10° C. or higher, and more preferably by 20° C. to 100° C.

When the temperature at which the coating film made of the second coating liquid is subjected to the heat treatment is set to be higher than the temperature at which the coating film made of the first coating liquid is subjected to the heat treatment, the zirconium oxide contained in the first layer is significantly eroded by the oxoacid contained in the second coating liquid such that the acid resistance of the thin-film layer that is finally obtained decreases. Therefore, in the second step, the temperature at which the inner wall made of the stainless steel plate is heated in the second step is set to be lower than the temperature at which the inner wall made of the stainless steel plate is heated in the first step.

In the second step, regarding the thickness of the coating film made of the second coating liquid, the thickness of the second layer formed after the heat treatment of the coating film made of the second coating liquid is not particularly limited, but is preferably adjusted to be, for example, 0.1 μm to 1 μm.

When the thickness of the second layer is less than 0.1 μm, it is difficult for the second layer to function satisfactorily. On the other hand, when the thickness of the second layer exceeds 1 μm, further effects of the second layer are not expected.

The content rate of the oxoacid in the second layer formed in the second step is preferably 0.5 mass % to 5 mass %, and more preferably 1 mass % to 3 mass %.

When the content rate of the oxoacid in the second layer is less than 0.5 mass %, the thin-film layer that is finally obtained may not achieve sufficient hydrophilicity. On the other hand, when the content rate of the oxoacid in the second layer exceeds 5 mass %, further effects cannot be expected, and this is economically wasteful.

In the step of forming the thin-film layer (hereinafter, referred to as "third step"), by removing the second layer by using the washing method, the thin-film layer which contains zirconium oxide and silicon oxide on the surface of the inner wall made of the stainless steel plate and has a contact angle of water of 20 degrees or less on the surface is obtained.

The second layer formed in the second step is easily removed after the heat treatment by using the washing method such as water washing. In the second step, the oxoacid contained in the second layer (specifically, the coating film made of the second coating liquid) acts to erode the zirconium oxide contained in the first layer by the heat treatment of the second layer, thereby increasing the hydrophilicity of the first layer. Accordingly, the hydrophilicity of the first layer, which is insufficient with only the zirconium oxide, can be increased.

In addition, the oxoacid or the salt of the oxoacid excessively contained in the second coating liquid becomes powder after the heat treatment and precipitates to the surface of the first layer. However, the oxoacid or the salt of the oxoacid can be easily removed by water washing. That is, the stainless steel plate that is finally obtained and forms the inner wall of the dishwasher has only the thin-film layer (single layer) containing zirconium oxide and silicon oxide on the surface.

Even when the oxoacid is incompletely removed from the thin-film layer by the water washing and thus remains, there is no problem.

The contact angle of water on the surface of the thin-film layer which is obtained as described above and contains the zirconium oxide and the silicon oxide is preferably 20 degrees or less, and more preferably 15 degrees or less.

When the contact angle of water on the surface of the thin-film layer is 20 degrees or less, oil stains adhering to the surface of the thin-film layer are easily removed. Moreover, during a drying process of the dishwasher, water droplets are not formed on the surface of the thin-film layer but a water film is formed and efficiently dried. Furthermore, the thin-film layer has excellent durability against an alkaline detergent and an acidic detergent.

In the embodiment, the contact angle of water for a sample after being washed and dried in a dishwasher is measured as a value regarding water using a contact angle meter (manufactured by Kyowa Interface Science Co., LTD.).

According to the method of manufacturing a dishwasher of the embodiment, a dishwasher having a hydrophilic inner wall made of stainless steel is obtained. Not only are stains such as oil less likely to adhere to the inner wall of the dishwasher, but also water droplets do not form on the inner wall after dishwashing. Therefore, the dishwasher enables quick drying and has excellent energy saving effects. Furthermore, the dishwasher has excellent durability against an alkaline detergent and an acidic detergent.

EXAMPLES

Hereinafter, the present invention will be described more specifically with reference to experimental examples, but the present invention is not limited to the following experimental examples.

Example 1

(Treatment of Stainless Steel Plate)

10 g of a mixed liquid of a zirconia sol aqueous dispersion and a colloidal silica aqueous dispersion ($ZrO_2$:$SiO_2$=9:1 (mass ratio), total solid content concentration 10 mass %) was spray-coated to the surface of a stainless steel plate (SUS304, 100 cm×100 cm) for a dishwasher, thereby forming a coating film made of the mixed liquid.

Next, the stainless steel plate having the coating film formed thereon was subjected to a heat treatment at 300° C. for one hour, thereby forming a first layer on the surface of the stainless steel plate.

Thereafter, the first layer was cooled by water washing, and the first layer was then dried at 60° C. for one hour.

Next, 10 g of a 5 mass % sodium tripolyphosphate aqueous solution was spray-coated to the surface of the first layer formed on the surface of the stainless steel plate for one minute, thereby forming a coating film made of the aqueous solution.

Next, the stainless steel plate having the coating film formed thereon was subjected to a heat treatment at 250° C. for one hour, thereby forming a second layer on the surface of the first layer.

Next, excess sodium tripolyphosphate precipitates were removed by water washing, thereby obtaining the stainless steel plate having a thin-film layer formed thereon. The thickness of the thin-film layer that was finally obtained was 200 nm.

Example 2

(Treatment of Stainless Steel Plate)

A stainless steel plate having a thin-film layer of Example 2 formed thereon was obtained in the same manner as in Example 1 except that a 5 mass % sodium aluminate aqueous solution was used instead of the 5 mass % sodium tripolyphosphate aqueous solution.

Example 3

(Treatment of Stainless Steel Plate)

A stainless steel plate having a thin-film layer of Example 3 formed thereon was obtained in the same manner as in Example 1 except that a 5 mass % sodium thiosulfate aqueous solution was used instead of the 5 mass % sodium tripolyphosphate aqueous solution.

Example 4

(Treatment of Stainless Steel Plate)

A stainless steel plate having a thin-film layer of Example 4 formed thereon was obtained in the same manner as in Example 1 except that a 5 mass % sodium borate aqueous solution was used instead of the 5 mass % sodium tripolyphosphate aqueous solution.

Comparative Example 1

(Treatment of Stainless Steel Plate)

A stainless steel plate having a thin-film layer of Comparative Example 1 formed thereon was obtained in the same manner as in Example 1 except that water was used instead of the 5 mass % sodium tripolyphosphate aqueous solution.

Evaluation (1) Measurement of Contact Angle of Water

The stainless steel plate having the thin-film layer formed thereon was installed on the inner wall of the dishwasher, and the contact angle of water of a sample after being subjected to a washing and drying operation was measured using a contact angle meter (manufactured by Kyowa Interface Science Co., LTD.). The results are shown in Table 1.

As a result, in Examples 1 to 4, the contact angle of water was 10° C., and no water droplets remained on the inner wall of the dishwasher.

On the other hand, in Comparative Example 1, the contact angle of water was 70°, and water droplets remained on the inner wall of the dishwasher.

(2) Evaluation of Alkali Resistance and Acid Resistance

For the stainless steel plate having the thin-film layer formed thereon, the alkali resistance and the acid resistance at a high temperature were evaluated.

Evaluation of the alkali resistance was performed by immersing the stainless steel plate in a 5 mass % finish aqueous solution at 80° C. for 30 days and thereafter visually observing impairment of the thin-film layer.

Evaluation of the acid resistance was performed by immersing the stainless steel plate in a 5 mass % citric acid aqueous solution at 80° C. for 30 days and thereafter visually observing impairment of the thin-film layer. The results are shown in Table 1.

As a result, impairment of the thin film layer was not observed in Examples 1 to 4 and Comparative Example 1.

(3) Evaluation of Adhesion of Thin-Film Layer

The stainless steel plate having the thin-film layer formed thereon was folded 180 degrees so that the thin-film layer was positioned on the outside, and the presence or absence of peeling of the thin-film layer was confirmed. The results are shown in Table 1.

As a result, in Examples 1 to 4 and Comparative Example 1, peeling of the thin-film layer was not observed.

TABLE 1

| | First layer heat treatment temperature (° C.) | Salt of oxoacid | Second layer heat treatment temperature (° C.) | Contact angle on surface of first layer (°) | Alkali resistance | Acid resistance | Adhesion | Determination |
|---|---|---|---|---|---|---|---|---|
| Example 1 | 250° C. | Sodium tripolyphosphate | 200° C. | 10 | Normal | Normal | Normal | Suitable |
| Example 2 | 250° C. | Sodium aluminate | 200° C. | 10 | Normal | Normal | Normal | Suitable |
| Example 3 | 250° C. | Sodium thiosulfate | 200° C. | 10 | Normal | Normal | Normal | Suitable |
| Example 4 | 250° C. | Sodium borate | 200° C. | 10 | Normal | Normal | Normal | Suitable |
| Comparative Example 1 | 250° C. | Water | 200° C. | 70 | Normal | Normal | Normal | Unsuitable |

From the above results, it was determined that the stainless steel plates of Examples 1 to 4 are suitable for use as the inner wall of the dishwasher wall, and the stainless steel plate of Comparative Example 1 is not suitable for use as the inner wall of the dishwasher wall.

Experimental Examples 1 to 5

30 parts by mass of zirconium tetrabutoxide as an alkoxide of zirconium, 10 parts by mass of ethyl acetoacetate, and 60 parts by mass of 2-propanol were mixed at room temperature (25° C.) for 60 minutes, thereby producing a chelated compound of the zirconium tetrabutoxide and the ethyl acetoacetate. A solution containing the chelated compound was defined as solution 1 ($ZrO_2$ solid content 10 mass %).

Next, 19 parts by mass of methoxysilane 51 (trade name, manufactured by COLCOAT Co., Ltd.) as an alkoxide of silicon was dissolved in 80 parts by mass of 2-propanol, and 1 part by mass of 10% nitric acid was then added thereto and mixed therein at room temperature (25° C.) for 60 minutes, thereby producing a partially hydrolyzed silica sol. A solution containing the partially hydrolyzed silica sol was defined as solution 2 ($SiO_2$ solid content 10 mass %).

As shown in Table 2, by appropriately changing the mixing ratio (mass ratio) of solutions land 2, 100 g of Coating Liquids 1 to 5 for forming the first layer were prepared.

TABLE 2

| Experiment No. | Solution 1 (parts by mass) | Solution 2 (parts by mass) | Amount of $ZrO_2$ (mass %) | Amount of $SiO_2$ (mass %) |
|---|---|---|---|---|
| 1 | 100 | 0 | 10 | 0 |
| 2 | 99 | 1 | 9.9 | 0.1 |
| 3 | 90 | 10 | 9 | 1 |
| 4 | 80 | 20 | 8 | 2 |
| 5 | 70 | 30 | 7 | 3 |

Examples 5 to 11, Comparative Examples 2 to 11

Coating Liquids 1 to 5 were roller-coated to the surface of the stainless steel plate (SUS304, 100 cm×100 cm) for the dishwasher to adhere thereto in an amount of 10 g, and thereafter the resultant was subjected to a heat treatment at a temperature shown in Table 3 for 30 minutes, thereby forming a first layer on the surface of the stainless steel plate.

Thereafter, the first layer was cooled by water washing, and the first layer was then dried at 60° C. for one hour. The film thickness of the obtained first layer was 500 nm.

Next, a 5 mass % sodium pyrophosphate aqueous solution was roller-coated to the surface of the first layer formed on the surface of the stainless steel plate to adhere thereto in an amount of 10 g, and the resultant was then subjected to a heat treatment at a temperature shown in Table 3 for 30 minutes, thereby forming a second layer on the surface of the first layer.

Thereafter, the second layer was cooled by water washing, and the second layer was then dried at 60° C. for one hour. The second layer was removed by using the water washing such that a thin-film layer (single layer) remained on the surface of the stainless steel plate as in the examples.

Evaluation

For the stainless steel plate having the thin-film layer formed thereon, in the same manner as in Examples 1 to 4 and Comparative Example 1, (1) measurement of the contact angle of water, (2) evaluation of alkali resistance and acid resistance, and (3) evaluation of adhesion of thin-film layer were conducted. The results are shown in Table 3.

TABLE 3

| | Coating liquid | First layer heat treatment temperature (° C.) | Second layer heat treatment temperature (° C.) | Contact angle on surface of first layer (°) | Alkali resistance | Acid resistance | Adhesion | Determination |
|---|---|---|---|---|---|---|---|---|
| Comparative Example 2 | 1 | 250° C. | 200° C. | 10 | Normal | Normal | Peeled | Unsuitable |
| Example 5 | 2 | 250° C. | 200° C. | 10 | Normal | Normal | Normal | Suitable |
| Example 6 | 3 | 250° C. | 200° C. | 10 | Normal | Normal | Normal | Suitable |
| Example 7 | 4 | 250° C. | 200° C. | 10 | Normal | Normal | Normal | Suitable |
| Comparative Example 3 | 5 | 250° C. | 200° C. | 10 | Peeled | Normal | Normal | Unsuitable |
| Example 8 | 3 | 250° C. | 100° C. | 10 | Normal | Normal | Normal | Suitable |
| Example 9 | 3 | 250° C. | 150° C. | 10 | Normal | Normal | Normal | Suitable |
| Comparative Example 4 | 3 | 250° C. | 250° C. | 10 | Normal | Peeled | Normal | Unsuitable |
| Comparative Example 5 | 3 | 250° C. | Untreated | 70 | Normal | Normal | Normal | Unsuitable |
| Comparative Example 6 | 5 | 250° C. | Untreated | 40 | Peeled | Normal | Normal | Unsuitable |
| Example 10 | 3 | 300° C. | 250° C. | 10 | Normal | Normal | Normal | Suitable |
| Comparative Example 7 | 3 | 300° C. | 300° C. | 10 | Normal | Peeled | Normal | Unsuitable |
| Comparative Example 8 | 3 | 200° C. | 200° C. | 10 | Normal | Peeled | Normal | Unsuitable |
| Example 11 | 3 | 200° C. | 150° C. | 10 | Normal | Normal | Normal | Suitable |
| Comparative Example 9 | 3 | 150° C. | 100° C. | 10 | Peeled | Peeled | Peeled | Unsuitable |
| Comparative Example 10 | Untreated | Untreated | 200° C. | 70 | Normal | Normal | Normal | Unsuitable |
| Comparative Example 11 | Untreated | Untreated | Untreated | 70 | Peeled | Normal | Normal | Unsuitable |

From the results of Table 3, suitable conditions for the hydrophilic stainless steel plate used for the inner wall of the dishwasher are as follows.

(1) In consideration of hydrophilicity, it is necessary that the second coating liquid containing an oxoacid is applied to the surface of the first layer to form the coating film made of the second coating liquid, and the coating film is subjected to the heat treatment to form the second layer containing the oxoacid on the surface of the first layer.

(2) In consideration of acid resistance, the heat treatment temperature at which the second layer is formed is set to be lower than the heat treatment temperature at which the first layer is formed.

(3) In consideration of alkali resistance, acid resistance, and adhesion, the heat treatment temperature of the first layer is set to be 200° C. or higher.

(4) In consideration of alkali resistance, the content rate of zirconium oxide in the first layer is 80 mass % or more.

(5) In consideration of adhesion, the content rate of silicon oxide in the first layer is 1 mass % to 20 mass %.

In the determination, suitable compositions are referred to as examples, and unsuitable compositions are referred to as comparative examples. Reasons for the unsuitability are considered to be as follows.

In Comparative Example 2, since silicon oxide was not contained, the adhesion was poor.

In Comparative Example 3, since the content rate of silicon oxide was high, the alkali resistance was decreased.

In Comparative Example 4, since the heat treatment temperature of the second layer was high, the acid resistance was decreased.

In Comparative Example 5, since no heat treatment was performed on the second layer, hydrophilicity was not obtained.

In Comparative Example 6, although the content rate of silicon oxide was increased to improve hydrophilicity to some extent, the hydrophilicity was insufficient, and the alkali resistance was also impaired.

In Comparative Example 7, even when the heat treatment temperature of the first layer was increased, since the heat treatment temperature of the second layer was high, the acid resistance was decreased.

In Comparative Example 8, even when the heat treatment temperature of the second layer low, since the heat treatment temperature of the first layer was low, the acid resistance was decreased.

In Comparative Example 9, since the heat treatment temperature of the first layer was too low, the thin film itself was insufficiently formed.

In Comparative Example 10, since only the second layer was formed, hydrophilicity was not exhibited.

Comparative Example 11 is a comparative untreated material.

INDUSTRIAL APPLICABILITY

A method of manufacturing a dishwasher of the present invention includes steps of: forming, by performing a heat treatment on the surface of an inner wall made of stainless steel at 200° C. or higher, a first layer containing zirconium oxide and silicon oxide on the surface of the inner wall; forming a second layer containing an oxoacid on the surface of the first layer by performing a heat treatment on the surface of the first layer at a temperature lower than the heat treatment temperature of the first layer; and obtaining a thin-film layer containing zirconium oxide and silicon oxide on the surface of the inner wall and having a contact angle of water of 20 degrees or less on the surface, after removing the second layer by using a washing method, in which the first layer contains the zirconium oxide in an amount of 80 mass % or more in terms of oxide and the silicon oxide in an amount of 1 mass % to 20 mass % in terms of oxide.

Therefore, the thin-film layer that is finally formed on the surface of the inner wall made of stainless steel has hydrophilicity, alkali resistance, and acid resistance, and the contact angle of water is 20 degrees or less on the surface of the thin-film layer, so that it is possible to prevent water droplets from remaining on the surface of the thin-film layer. That is, in a dishwasher manufactured according to the method of manufacturing a dishwasher of the present invention, water droplets do not form on the surface of the thin film after dishwashing. Therefore, the dishwasher enables quick drying and has excellent energy saving effects, and thus the industrial value thereof is extremely high.

The invention claimed is:

1. A method of manufacturing a dishwasher having an inner wall made of a stainless steel plate, comprising steps of:

forming a first layer comprising zirconium oxide and silicon oxide on a surface of the inner wall at a heat treatment temperature of 200° C. or higher;

forming a second layer comprising an oxoacid on a surface of the first layer at a heat treatment temperature lower than the heat treatment temperature of the first layer; and obtaining a thin-film layer comprising zirconium oxide and silicon oxide on the surface of the inner wall and having a contact angle of water of 20 degrees or less on the surface, after removing the second layer by using a washing method, wherein the first layer contains the zirconium oxide in an amount of 80 mass % or more in terms of oxide and the silicon oxide in an amount of 1 mass % to 20 mass % in terms of oxide.

2. The method of manufacturing a dishwasher according to claim 1, wherein the oxoacid is at least one selected from the group consisting of an oxoacid of phosphorus, aluminum, sulfur and boron; or a salt thereof.

3. The method of manufacturing a dishwasher according to claim 1, wherein the step of forming the first layer comprises steps of:

forming a first coating film by applying a first coating liquid comprising a precursor of the zirconium oxide and a precursor of the silicon oxide to the surface of the inner wall; and forming the first layer on the surface of the inner wall by subjecting the first coating film to a heat treatment at 200° C. or higher.

4. The method of manufacturing a dishwasher according to claim 1, wherein the step of forming the second layer comprises steps of:

forming a second coating film by applying a second coating liquid comprising the oxoacid to the surface of the first layer; and forming the second layer on the surface of the first layer by subjecting the second coating film to a heat treatment at a temperature lower than the heat treatment temperature of the first layer.

5. The method of manufacturing a dishwasher according to claim 4, wherein the second coating liquid comprises the oxoacid and a solvent, and the second layer substantially does not contain the solvent.

6. The method of manufacturing a dishwasher according to claim 1, wherein the first layer substantially does not contain organic substances.

7. The method of manufacturing a dishwasher according to claim 1, wherein the second layer substantially does not contain a solvent.

* * * * *